United States Patent [19]

Schmanski

[11] Patent Number: 4,571,118

[45] Date of Patent: Feb. 18, 1986

[54] SIMULATED TUBULAR HIGHWAY SAFETY DEVICE

[75] Inventor: Donald W. Schmanski, Carson City, Nev.

[73] Assignee: Carsonite International Corporation, Carson City, Nev.

[21] Appl. No.: 572,366

[22] Filed: Jan. 20, 1984

[51] Int. Cl.[4] ..... E01F 9/00

[52] U.S. Cl. ..... 404/10; 404/11; 404/16; 40/612; 116/63 R

[58] Field of Search ..... 404/6, 9, 10, 11, 14, 404/16; 256/1, 13.1; 40/608, 612; 52/108, 113; 116/63 R, 63 P

[56] References Cited

U.S. PATENT DOCUMENTS

| | | | |
|---|---|---|---|
| 1,250,064 | 12/1917 | Whims | 52/108 X |
| 4,318,079 | 3/1982 | Dickinson | 404/6 X |

FOREIGN PATENT DOCUMENTS

| | | | |
|---|---|---|---|
| 1907864 | 9/1970 | Fed. Rep. of Germany | 40/612 |
| 1301141 | 7/1962 | France | 404/6 |
| 413673 | 12/1966 | Switzerland | 404/10 |

*Primary Examiner*—Stephen J. Novosad
*Assistant Examiner*—John F. Letchford
*Attorney, Agent, or Firm*—Calvin E. Thorpe; Vaughn W. North; M. Wayne Western

[57] ABSTRACT

A simulated tubular member for use as part of a highway safety device wherein the tube is comprised of a stiff, resilient rod which provides rigidity to maintain the simulated tube in straight orientation during static conditions, but deflects upon impact to avoid destruction. The rod includes a plurality of plastic bulbs which are configured to provide the appearance of a hollow plastic tube in conformance with state and federal highway specifications.

12 Claims, 9 Drawing Figures

SIMULATED TUBULAR HIGHWAY SAFETY DEVICE

BACKGROUND OF THE INVENTION

1. Field of the Invention

This invention pertains to highway delineation and safety devices comprising flexible plastic structures which simulate the distant appearance of a plastic tube. More particularly, the subject matter of this invention relates to an elongated, flexible highway safety device which has the appearance of a tube but is not subject to elastic failure generally occurring in tubes as they are impacted by high-speed vehicles.

2. Prior Art

The uses of plastic tubing within the field of highway safety include its incorporation in barriers, delineators or markers. Such devices are provided to attract the attention of an observer for purposes of safety, guidance or information awareness. For example, barriers fabricated of plastic tubing may be positioned in the path of moving traffic to divert the direction of movement along a different course. Likewise, such tubing may be positioned along a roadside to delineate curvature or other changes in direction which a traveler must follow. Other applications involve use as a marker for providing day or nighttime identification of roadsides, hazardous areas and conditions where extra caution or attention may be required. In addition to the obvious characteristic of high visibility, tubular structure provides the benefit of minimal material cost because most of the material making up the tube is exposed at the tube surface. The tubular configuration also offers the desirable features of stiffness, resilience, flexibility, and light weight. For example, tubular structure has been effective against frequent impact where the stiff tubular structure is designed to deflect under a vehicle and then rebound to its original orientation.

It is well-known, however, that the same tubular structure which develops these favorable characteristics also includes a major deficiency in highway applications. Specifically, plastic tubes tend to form weakened "hinge" areas, where the elastic limit of the material is exceeded during impact. For example, FIG. 1 shows a plastic tube 10 having cylindrical shape 15 which has been deflected 13 by a bending moment M, displacing the tube from a straight orientation 16 to a bent orientation 17. Although those parts of the tube 11 and 12 away from the bend are substantially unaffected, the plastic at the localized hinge area 13 is greatly stressed. Typically, sharp dimples 18 form on each side of the bend 13 where the elasticity of the tube wall is exceeded. The result is loss of stiffness and resilience at that local hinge site. Furthermore, this weakened location becomes the likely target for recurring collapse, causing further damage to the tubular structure and reducing its ability to restore itself to upright position. After numerous repetitions, the tube becomes permanently deformed, as shown in FIG. 1, and must be replaced.

Where plastic tube structure is used in a horizontal barrier device, additional problems arise because of the limited stength of the tube when unsupported. For example, long lengths of tube frequently collapse because of their own weight if suspended at one end. Unsupported intermediate sections of tube tend to sag or even collapse to form a hinge point similar to that in FIG. 1. Here again, a first collapse in tube structure causes weakened elastic character inevitably leading to a permanent sagging structure which may destroy functionality as well as appearance.

What is needed, therefore, is a vertical tubular structure which can deform without localized elastic failure and thereby remain serviceable, despite repeated impacts. Furthermore, it would be beneficial to have a tubular structure capable of supporting its own weight whether suspended in the horizontal or vertical orientation.

OBJECTS AND SUMMARY OF THE INVENTION

It is therefore an object of the present invention to provide a simulated tubular structure which resists formation of a hinge site under impact, but retains its resilience regardless of the amount of deflection.

It is a further object of the present invention to provide a simulated tube structure of substantial length which can support its own weight when suspended at one end.

It is yet another object of this invention to provide a simulated tube structure which includes favorable properties of being lightweight, stiff, flexible, resilient and highly visible.

A still further object of the present invention includes a simulated tube structure which can withstand relatively high-speed impacts without bending at a hinge site or otherwise causing local elastic failure of the tubular body.

An additional object of the present invention is a simulated tubular structure which can be used as a horizontally disposed traffic gate which can withstand inadvertent automobile impact, yet is capable of supporting its weight in horizontal position.

It is a further object of the present invention to provide simulated tubular structure which can be readily adapted for use as substitute structure for conventional thin-walled tubes, including use as highway delineators, markers, barriers, and tubular warning devices.

These and other objects are realized in a flexible, plastic structure simulating the distant appearance of a plastic tube and having concurrent properties of (i) stiffness for maintaining a rigid, substantially straight tube orientation during static conditions; and (ii) resilient flexibility to enable deformation of said structure during dynamic conditions without elastic failure normally associated with a plastic tube when subjected to extreme, localized stress. This combination of conflicting properties is concurrently embodied in the present inventive structure which includes a stiff, resilient, lightweight rod having values of elastic modulus (E) and moment of inertia (I) which permit at least 90° deflection of the rod from its normal straight orientation in response to a bending moment M, such deflection being characterized by formation of a bending radius in the rod defined by the relationship $R=EI/M$. Furthermore, the rod must concurrently have values of E and I which provide sufficient rigidity to the rod in static conditions to support the full length of the simulated tube in a straight tube orientation. A plurality of unitary, elongated, resilient plastic bulbs are positioned coaxially along the rod, concealing the enclosed rod structure. Each bulb comprises an elongated tubular midsection bound on each end by a tapering wall section which converges to an integral mounting stem. The stem has an opening positioned at the central axis of the elongated tubular section which permits implacement on the rod in stem-to-stem orientation. This opening is slightly larger than the diameter of the rod to provide a tight fit of the bulb on the rod.

This inventive structure provides several immediate benefits over the prior art. For example, the tubular structure of each bulb provides an appearance of a plastic tube, yet has increased stiffness and resilience because of the contained rod. Furthermore, the response of the rod to form a bending radius, as opposed to a hinge site, prevents elastic failure and permanent damage to the simulated tube structure.

Other objects and features of the present invention will be apparent to those skilled in the art in view of the following detailed description of the invention, taken in combination with the accompanying drawings.

DETAILED DESCRIPTION OF THE INVENTION

Figure 3:
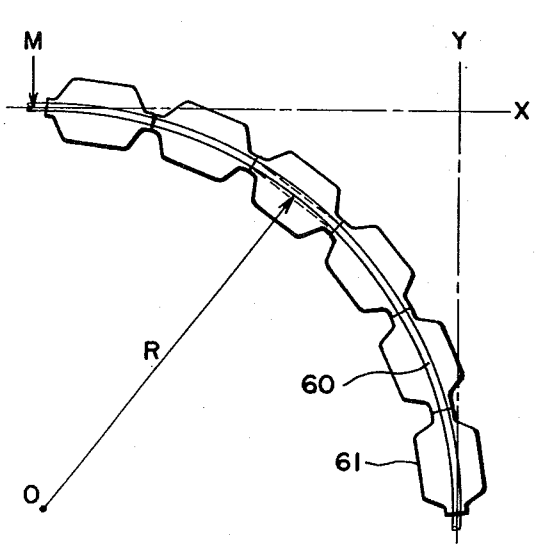
FIG. 3 graphically illustrates the bending radius formed by the simulated tube.
Figure 1:
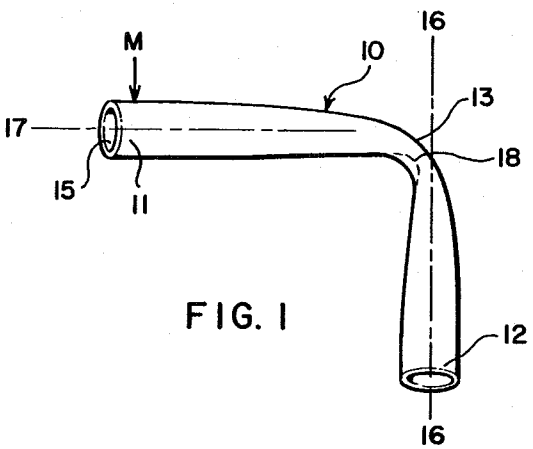
FIG. 1 illustrates a conventional plastic tube which experiences destructive hinge formation by virtue of localized stress.
Figure 2:
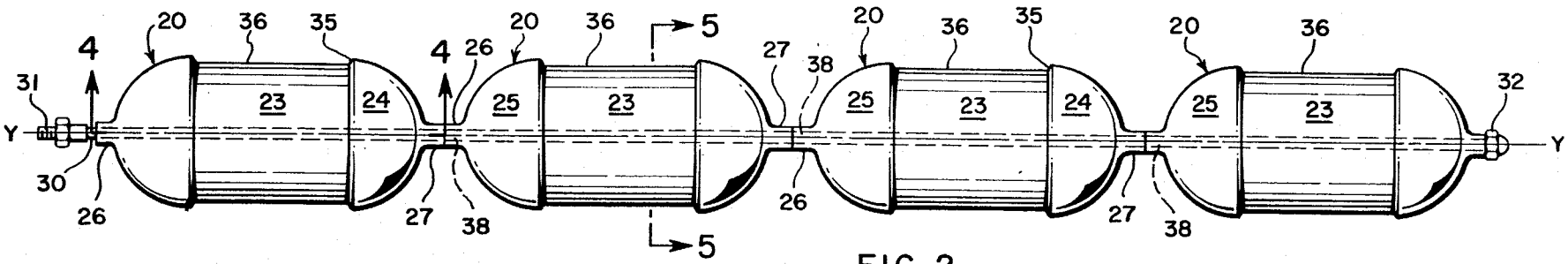
FIG. 2 shows a segment of a simulated plastic tube in accordance with the present invention.

Referring now to the drawings:

A flexible, plastic structure simulating the distant appearance of a hollow plastic tube and useful as a device for highway delineation is shown in FIG. 2. The overall construction of the device must provide sufficient stiffness for maintaining a rigid, substantially straight tube orientation along its longitudinal axis Y during static conditions wherein no exterior forces are applied to the device. In addition, the same structure must provide resilient flexibility to enable its deformation during dynamic conditions, such as might result where a vehicle impacts the device, causing it to be bent as shown in FIG. 3. The primary advantage of the present invention over prior tubular structure arises from the fact that the present invention does not experience elastic failure normally associated with extreme localized stress resulting where the prior art tubular device collapses to form a hinge site 13 as illustrated in FIG. 1.

The incorporation of the conflicting properties of rigidity and flexibility are realized by the use of simulating tube structure as shown in FIG. 2. As used herein, "simulating" has reference to the visual appearance of the subject invention at a distance of 15 or 20 feet wherein the device appears to look like a conventional tube structure. In the highway industry, tubular delineation has existed for many years and is commonly recognized by its upright orientation with reflective tape positioned in alternating stripes. This prior art tubular structure is characterized by a hollow core which collapses upon being bent during impact or other dynamic motion. Although the present invention does not constitute literal tubular structure, its appearance at a distance simulates the accustomed features associated with tubular delineators and therefore, realizes the same objectives to a casual observer.

The significance of such visual simulation in the highway industry goes far beyond mere cosmetic purposes. Federal and state safety standards prescribe specifications, widths, heights, reflective striping parameters, and numerous standards which have been accepted at state and federal government levels. The objective of such standardization is to develop public ability to recognize a specific configuration and relate that configuration to a specific warning or purpose. This pattern has been followed with respect to standard warning devices relating to speed zones, warning and caution signs, specific hazardous areas, etc. In view of the fact that the highway traveler frequently has limited time and visual awareness, standardized delineation devices have been provided which enable immediate recognition. The simulated tube structure of the present invention is adapted to meet the various state and federal specifications for tubular structures and is accordingly denominated a "simulated" tube.

As shown in FIG. 2, one embodiment of the subject invention comprises a plurality of unitary, elongated, resilient plastic bulbs 20 which are positioned on a stiff, resilient, lightweight rod 38 in end-to-end orientation. The rod 38 may be constructed of numerous materials, provided that the elastic modulus (E) and moment of inertia (I) reflecting the rod cross-section meet two requirements. First, the rod must be capable of deflection to at least 90° with respect to the Y axis as shown in FIG. 3. The deflection contemplated by the present invention conforms to the formation of a bending radius R which is generally defined by the relationship $R=EI/M$. In the present invention, the value of R is substantially determined by the product of E and I for the rod 60 as it is affected by the bending moment M (see FIG. 3). This is to be contrasted with prior art deformation of a tube structure which conforms primarily to a hinge or buckling response and not the formation of a bending radius R.

In addition to the required deformation based on formation of the referenced bending radius, the values of E and I for the rod must provide sufficient rigidity during static conditions to support the full length thereof, including the plastic bulbs positioned thereon. Such a condition would exist whether the simulated tube were in vertical or horizontal orientation.

The preferred embodiment of the present invention utilizes a fiber-reinforced plastic of thermosetting resin which incorporates the desired rigidity and formation of bending radius in a single structure. The rod may be fabricated by conventional pultrusion techniques wherein roving is passed through a thermosetting resin bath for saturation of reinforcing fibers prior to curing to a rigid final state. The uniform cross-section developed by the pultrusion process along the length of the rod is ideal for maintaining a uniform radius of curvature and for economical assembly of the plastic bulbs on the rod. Other plastic compositions of both reinforced and non-reinforced structure may be substituted within the given parameters and may be preferable for specialized applications. The pultruded fiber-reinforced thermosetting resin appears to be satisfactory for general applications.

As previously mentioned, the material composition E and geometric shape I are the primary factors in determining the bending radius and stiffness of the rod 38. Although the rod diameter will generally fall within the range of 0.4 centimeters to 1.8 centimeters, the lower range of 0.4 to 0.8 centimeters generally provides the proper balance between stiffness and flexibility for uses within the field of highway safety products. It will be apparent to those skilled in the art that the actual dimensions can be tailored to the specific characteristics required for the simulated tube. Where the device is primarily to be used as a horizontal beam with minimum deflection, greater stiffness may be developed by increasing the diameter with a proportionate increase in moment of inertia.

A typical composition of fiber and resin in a pultruded rod will be approximately 26% (W) resin and 74% (W) reinforcing fiber. Because transverse strength is not a critical factor where the rod is deformed to a bending radius, the fiber utilized is primarily roving. A general range of fiber versus resin composition which is required to maintain the conflicting properties of rigidity and flexibility previously discussed is 22 to 32% (W) resin and 68 to 78% (W) roving.

The plastic bulbs 20 provide the visual simulation of a tube surface. Each bulb includes three integral parts which form the unitary, elongated resilient structure. In the preferred embodiment, these three integral parts are configured symmetrically about a common longitudinal axis Y. The largest portion of the bulb is a tubular body 23 which forms the midsection of the bulb. This tubular body 23 has a sufficient diameter to enable immediate visual observation at distances greater than 500 feet. Typically, the diameter will be at least 7.5 centimeters and will have a length suitable for attachment of reflective material around its circumference which will conform with state and federal highway specifications.

Figure 7:
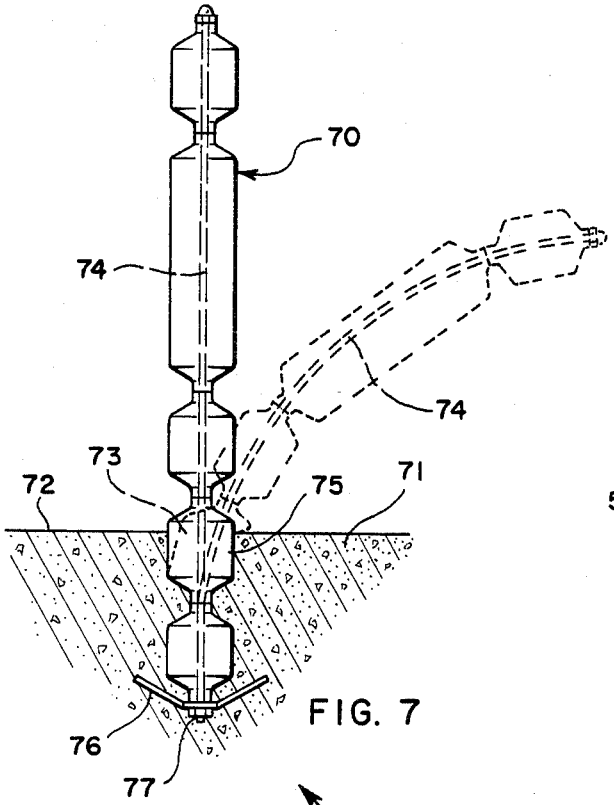
FIG. 7 shows an example of a delineator application of the present invention, wherein the simulated tube is partially buried below ground level.
Figure 9:
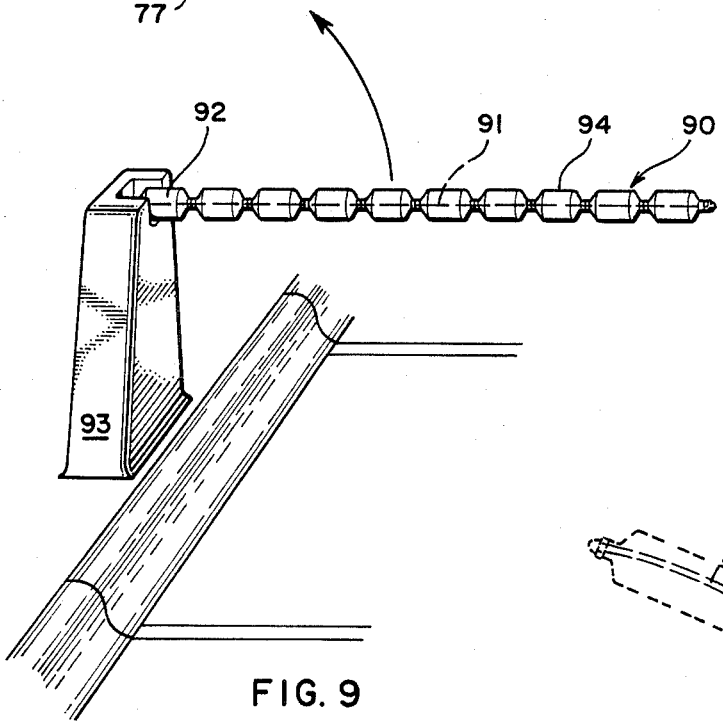
FIG. 9 illustrates the use of the present simulated tube as part of a traffic control gate such as used at the entrance or exit of a parking lot.
Figure 8:
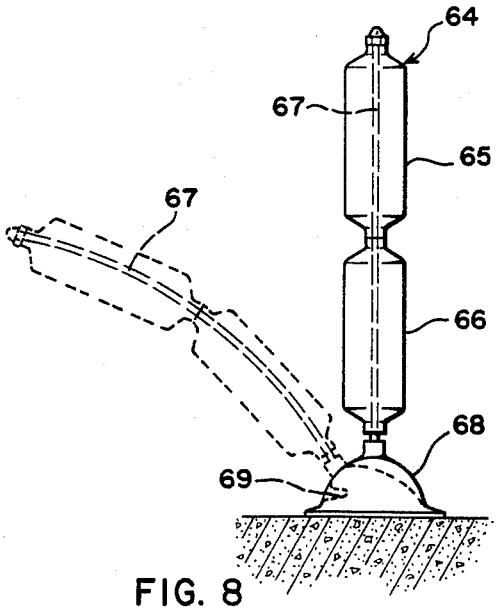
FIG. 8 shows a ground mounted delineator device formed of the simulated tube of the present invention.

The opposing ends of the tubular midsection 23 are closed by a tapering wall section or closing surface 24 and 25 which converges to the longitudinal axis Y and projects beyond each end of the midsection. This closing surface 24 or 25 may be shaped in hemispherical configuration as shown in FIG. 2, or it may be conically tapered, as illustrated in FIGS. 7, 8 and 9. The distal end of the respective closing surfaces comprises a stem 26 and 27 which has an opening 30 designed to fit snugly over the rod 38. This enables the plurality of bulbs to be inserted upon the rod in adjacent, end-to-end orientation so that substantially all of the rod surface is covered by the tubular bulbs, giving the simulation of a tubular structure.

The simulated tubular structure illustrated in FIG. 2 is primarily designed for nighttime delineation and corresponds to a prior art, tubular delineator having alternating reflective and non-reflective surfaces. The tubular midsections 23 are recessed 35 to enable attachment of reflective tape. The recessed configuration operates to protect the edges of the tape from being scraped free of the plastic bulb 20. In this embodiment, the length of the midsection 23 is approximately equal to the combined lengths of the closing surfaces 24 and 25. This results in alternating reflecting and non-reflecting areas which are substantially equal in length and give the impression of a tubular structure having the conventional alternating reflective strips between non-reflecting surface area on the tube delineator.

Figure 5:
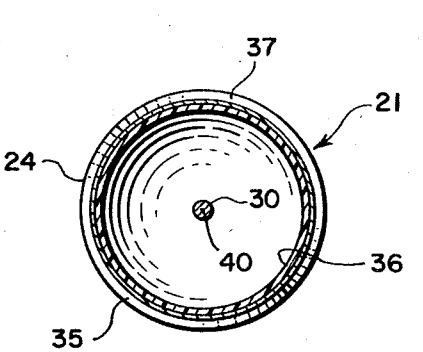
FIG. 5 shows a cross-section of a single bulb taken along the line 5—5 of FIG. 2.
Figure 4:
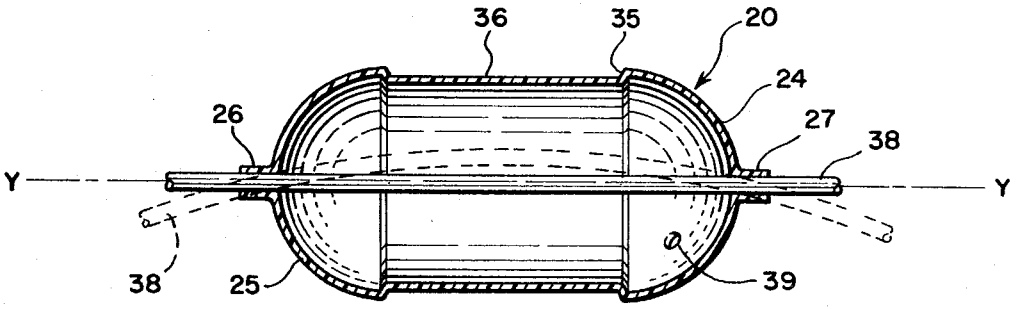
FIG. 4 is a cross-section of a single bulb, taken along the line 4—4 of FIG. 2.

The bulbs 20 illustrated in FIG. 2 are hollow and have thin wall structure to minimize bulb weight (see FIGS. 4 and 5). Resilience for the thin wall plastic structure is improved by adapting the respective stems 26 and 27 on each bulb for a tight fit on the rod 38. In this configuration, the enclosed air within the bulb hollow provides a cushion upon impact and resists complete collapse of the thin wall structure. This air cushion prevents sharp impact between the colliding object and the rod 38. A small hole 39 is provided to allow gradual air intake required for return of the bulb to normal shape. This is important in view of the absence of reinforcing fabric or transverse fibers which would generally be included where sharp impact was anticipated to prevent localized fracture of the rod. Instead, the impacting object strikes the bulb and is resisted by air compression which occurs upon partial collapse of the bulb around the rod, such resistance being sufficient to cause deflection of the rod from its straight orientation and to reduce fracturing contact between the rod and the impacting object.

An important aspect of the present invention is a capability of the rod 38 to deform into a bending radius within the bulb 20. Such deformation is suggested by the phantom lines shown in FIG. 4. The described free movement of the rod 38 within the bulb 20 helps to avoid sharp bending of the tubular midsection which tends to create dimples or elastic failure in the tube wall, as well as cause separation of the reflective material from the tubular midsection. This free movement also enables the rod 38 to deform into its bending radius, without deforming the tubular midsection and causing destruction or separation of the reflective material 36.

Figure 6:
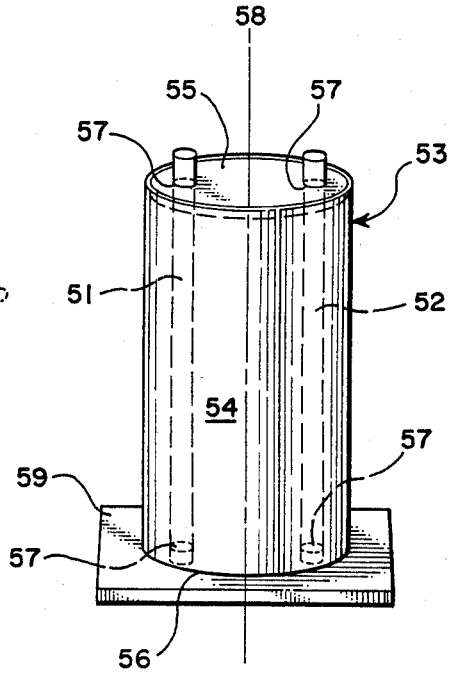
FIG. 6 shows a simulated tube of elliptical cross section using a pair of stiffening rod structures.

FIG. 6 depicts an additional embodiment of the subject invention utilizing two stiffening rods 51 and 52. These rods are contained within and support a single tubular element 53 which comprises an elliptical shaped, tubular midsection 54 which is bounded on each end by a closing surface 55 and 56. Each closing surface converges to a pair of openings 57 positioned toward the lateral extremities of the tubular structure in symmetrical orientation and at equal distances around the longitudinal axis 58 of the tube 53. The size of the openings are such that the rods may be inserted therein with a tight fit. These openings 57 operate to fix the position of the rods at parallel orientations with respect to the axis 58. During impact, the rods are free to deform within the cavity of the tube and will force the tube to collapse within the radius of curvature for the rods. By virtue of the stiffening effect of the rods, the tubular structure is not subject to the formation of a hinge situs, but remains in proper upright orientation despite repeated impacts. A base 59 is attached at the lower ends of the rods to mount the structure at a road surface or other desired location.

FIG. 8 illustrates another embodiment of the present invention which is specifically adapted for use in high-speed impact environments which are more likely to cause fracture of the supporting rod. This embodiment utilizes two elongated plastic bulbs 65 and 66 which are mounted on a fiber-reinforced rod 67 in accordance with the techniques previously discussed. This combination comprises the simulated tube portion 64 of the present invention. It is attached to a base 68 formed of a deformable plastic or rubber which enables the impact force to be transferred into the base 68, thereby decreasing the degree of deflection required for the rod to pass under a moving vehicle. Deformation of the base 68 is shown in phantom lines, with a collapsed section 69 which has sufficient resilience to restore the simulated tube 64 to its upright orientation. Here again, the freedom of movement of the rod 67 within the respective bulbs 65 and 66 enable the bulbs to displace out of the vertical orientation during impact, without damage to the thin wall surface or attached reflective material.

FIG. 7 discloses another embodiment of the simulated tube adapted for installation into the ground. It comprises a simulated tube 70 adapted for upright orientation. It is to be installed into the ground 71 such that ground level 72 intercepts the tube at a tubular midsection to thereby provide freedom of movement for the rod 74 within the interior of the ground level bulb 75. If the rod 74 were merely mounted in the ground, the inability of the rod to deform at ground level to thereby make a radius of curvature would likely result in the impacting object shearing the rod at ground level. This likelihood is greatly reduced where the rod has the capacity to move two or three centimeters in any direction at ground level by virtue of the space provided within the hollow of the ground level bulb 75.

To prevent the tubular structure 70 and rod from being pulled from the ground, means 76 is provided to anchor the rod below ground level. The illustrated means 76 comprises an upwardly projecting fork which is retained on the tube by locking means 77 attached at the end of the rod 74. Other equivalent retaining devices may be utilized with equal effectiveness. An additional embodiment of the subject simulated tube is shown in FIG. 9. In this instance, the simulated tube is adapted for horizontal orientation as part of a traffic control device, such as is typically used to control access into a parking lot. It includes a length of simulated tube 90 which may vary between 6 to 10 feet. The supporting rod 91 has a composition (E) and diameter (I) which provides sufficient rigidity to enable the simulated tube 90 to act as a beam suspended on one end 92 by a control device 93 which raises or lowers the simulated tube 90 as needed. This use of the present invention is designed to replace inflexible boards or metal guard arms which have been required in the past because of the inability of a tubular device to support its own weight when suspended at one end in horizontal orientation. Accordingly, the present invention provides a visual obstacle for blocking traffic flow, but is not subject to breakage, as has been the case with prior art wood or metal guard arms. Upon impact, the rod 91 is able to deflect and remain serviceable. This application illustrates that the simulated tube of the present invention is capable of uses which extend far beyond the prior art uses of a standard tubular highway safety device. In this manner, the present invention clearly shows a substantial improvement over the prior art. It will be apparent to those skilled in the art that other applications and uses of the subject tubular device are envisioned. Accordingly, this invention is not to be limited by reason of the preferred embodiments illustrated herein, but shall be construed in accordance with the following claims.

I claim:

1. A flexible, plastic structure simulating the distant appearance of a hollow plastic tube and having concurrent properties of (i) stiffness for maintaining a rigid, substantially straight tube orientation during static conditions; and (ii) resilient flexibility to enable deformation of said structure during dynamic conditions without elastic failure normally associated with a plastic tube when subjected to extreme, localized stress, this combination of conflicting properties being embodied in a simulated tube structure comprising:

a stiff, resilient, lightweight rod having values of elastic modulus (E) and moment of inertia (I) which (i) permit at least 90° deflection of said rod from a straight orientation in response to a bending moment (M) with resultant formation of a bending radius in the rod defined by the relationship $R=EI/M$ and (ii) provide sufficient rigidity to the rod in static conditions to support the full length of the simulated tube in a straight tube orientation;

at least one unitary, elongated, resilient plastic bulb having lightweight structure of three integral parts configured about a common longitudinal axis, including (i) a tubular body forming a midsection of the bulb having sufficient diameter to enable immediate visual observation at distances greater than 500 feet, and (ii) opposing closing surfaces at each end of the tubular midsection which respectively converge to an opening positioned on a line parallel to the common axis and having an opening size adapted to fit snugly around the rod, said bulb being inserted upon the rod and being adapted to cover all but opposing ends of the rod; and retaining means coupled at the opposing ends of the rod for retaining the mounted bulb in proper position thereon.

2. A flexible, plastic structure simulating the distant appearance of a plastic tube and having concurrent properties of (i) stiffness for maintaining a rigid, substantially straight tube orientation during static conditions; and (ii) resilient flexibility to enable deformation of said structure during dynamic conditions without elastic failure normally associated with a plastic tube when subjected to extreme, localized stress, this combination of conflicting properties being embodied in a simulated tube structure comprising:

a stiff, resilient, lightweight rod having values of elastic modulus (E) and moment of inertia (I) which (i) permit at least 90° deflection of said rod from a straight orientation in response to a bending moment (M) with resultant formation of a bending radius in the rod defined by the relationship $R=EI/M$ and (ii) provide sufficient rigidity to the rod in static conditions to support the full length of the simulated tube in a straight tube orientation; and a plurality of thin-walled, resilient, plastic bulbs, each bulb having an elongated tubular midsection bound on each end by a tapering wall section which converges to an integral mounting stem, said stem having an opening positioned at the central axis of the elongated tubular section for placement on the rod in stem-to-stem orientation, said opening being sized slightly larger than the diameter of the rod for a tight fit on the rod, said tubular section being at least equal in length to the combined lengths of the attached tapering sections.

3. A simulated tube as defined in claim 1 or 2, wherein the rod is a composite structure of resin and reinforcing roving fibers.

4. A simulated tube wherein the closing surfaces of the bulb defined in claim 1 or the tapering wall section of the bulb defined in claim 2 are hemispherical in configuration, having a radius approximately equal to the radius of the tubular midsection.

5. A simulated tube wherein the closing surfaces of the bulb defined in claim 1 or the tapering wall section of the bulb defined in claim 2 are conical in configuration.

6. A simulated tube as defined in claim 1 or claim 2, wherein the values of elastic modulus are within the range of 4 to 6 million, wherein R is greater than 12 cm.

7. A simulated plastic tube as defined in claim 1 or 2, wherein the interior of the plastic bulbs is hollow, permitting free movement of the rod therein, each bulb being adapted for tight fit on the rod such that an impacting force applied to the bulb exterior is resisted by air compression which occurs upon partial collapse of the bulb around the rod, said resistance being sufficient to cause deflection of the rod from its straight orientation to thereby avoid fracturing contact at the rod by an impacting object.

8. A device as defined in claim 1 wherein the tubular midsection has an elliptical cross section of uniform configuration along its length and is bounded at each end by closing surfaces which respectively converge to a pair of openings positioned toward the lateral extremities of the elliptical cross-section in symmetrical orientation and at equal distances around the rods, said device comprising two rods which fit tightly in the respective openings and have parallel orientation with respect to the longitudinal axis of the tubular midsection, each rod having values of elastic modulus (E) and moment of inertia (I) which (i) permit at least 90° deflection of each rod from a straight orientation in response to a bending moment (M) with resultant formation of a bending radius in each rod defined by the relationsip $R=EI/M$ and (ii) provide sufficient rigidity to the two rods in static conditions to support the full length of the tube in a straight orientation.

9. A simulated tube as defined in claim 1 or 2, wherein the total length of each plastic bulb is at least 7.5 centimeters, but no greater than 25 centimeters, with at least 50 percent of such length comprising tubular midsection.

10. A simulated tube as defined in claim 1 or 2, wherein the tube is adapted to be partially buried below ground level in upright orientation with the ground level intercepting the simulated tube at the tubular midsection to thereby provide freedom of movement to the rod within the interior of the ground level bulb, the simulated tube further comprising means for retaining its buried position during impact of a foreign object at an exposed section of the simulated tube above ground level.

11. A simulated tube as defined in claim 1 or 2, wherein the simulated tube is coupled at one end of the rod to means for surface mounting.

12. A simulated tube as defined in claim 1 or 2, wherein the simulated tube is mounted to a traffic control mechanism adapted to suspend the simulated tube in a horizontal, blocking position along a traffic thoroughfare and which further operates to raise the simulated tube to a non-blocking vertical orientation to allow traffic to pass unobstructed.

* * * * *